United States Patent [19]

Winther

[11] 4,102,136

[45] Jul. 25, 1978

[54] PUMP SYSTEM PROVIDING SELECTIVE DIRECTIONAL FLOW ACROSS FLUID BARRIER

[76] Inventor: John L. Winther, 12 El Sereno Rd., Orinda, Calif. 94563

[21] Appl. No.: 793,677

[22] Filed: May 4, 1977

[51] Int. Cl.[2] ..... E02B 7/20

[52] U.S. Cl. ..... 61/29; 47/48.5; 417/61

[58] Field of Search ..... 61/12, 10, 14, 15, 29, 61/28, 17, 18, 1; 47/48.5; 417/61; 415/7

[56] References Cited

U.S. PATENT DOCUMENTS

| | | | |
|---|---|---|---|
| 3,617,146 | 11/1971 | Garland | 417/61 |
| 3,918,264 | 11/1975 | Bradshaw | 61/12 |
| 4,024,717 | 5/1977 | Hudson et al. | 61/29 |

*Primary Examiner*—Jacob Shapiro
*Attorney, Agent, or Firm*—Townsend and Townsend

[57] ABSTRACT

A pump and pump manifolding system is disclosed for producing selected directional flow across a barrier, such as a levee, between at least a plurality of adjacent reservoirs such as shallow ponds. Typically, a housing which has at least two sidewalls is placed in the barrier. One of the sidewalls forms the fluid-tight barrier or interface with the pond on one side of the levee. The other of the sidewalls forms the fluid-tight barrier or interface with the pond on the other side. The housing itself is divided into upper and lower fluid chambers; the lower fluid chamber is adapted for the inflow of fluid to be pumped and the upper fluid chamber adapted for the outflow of fluid to be pumped. A pump, typically of the high flow, low head, impeller or propeller variety, has an intake communicated to the lower chamber and a discharge communicated to the upper chamber. Each of the sidewalls includes a first opening portion for establishing fluid communication between the lower chamber of said housing and the adjacent reservoir and a second opening portion for establishing fluid communication between the upper chamber and the fluid reservoir. By the simple expedient of opening one portion of one sidewall to the upper chamber and opening a second portion in the other sidewall to the lower chamber, selective directional flow between the adjacent reservoirs can occur.

9 Claims, 4 Drawing Figures

PUMP SYSTEM PROVIDING SELECTIVE DIRECTIONAL FLOW ACROSS FLUID BARRIER

Statement of the Problem With Reference to the Prior Art

When a field is flooded for irrigation purposes an objectionable accumulation of salt occurs unless the field is innundated and drained quickly. Moreover, it is necessary that the water not be allowed to stand too long in order to prevent the growth of botulism in parts of the field. Additionally to conserve water, it is expedient to use the water drained from one field to flood another. Thus a common practice is to divide a field up into several smaller plots separated from one another by two sets of intersecting levees. Each plot can then be flooded independent of the others, and water need only be pumped over or through one of the levees to accomplish the desired transfer.

A typical pump installation, one type of which is shown in my U.S. Pat. No. 3,851,996, has a conduit piercing a levee or levee weir. Even if the pump is reversible, a separate pump (or at least a pump location) is required at every interface between two adjacent plots, if it is desired to be able to pump from any plot to any plot via a direct route. Thus a field that is divided up into a rectangular array consisting of $m$ by $n$ rectangular plots requires $(m-1)n + (n-1)m$ separate pumps or pump sites. For a field broken down into 18 plots (6 by 3), this is 27 pumps. It is possible to reduce the number of pumps and still have every plot accessible from every other one by not requiring that the flow take place by a direct route. The number of pumps required is $mn-1$. Thus for the 6 by 3 array, 17 pumps are needed.

SUMMARY OF THE INVENTION

A pump and pump manifolding system is disclosed for producing selected directional flow across a barrier, such as a levee, between at least a plurality of adjacent reservoirs such as shallow ponds. Typically, a housing which has at least two sidewalls is placed in the barrier. One of the sidewalls forms the fluid-tight barrier or interface with the pond on one side of the levee. The other of the sidewalls forms the fluid-tight barrier or interface with the pond on the other side. The housing itself is divided into upper and lower fluid chambers; the lower fluid chamber is adapted for the inflow of fluid to be pumped and the upper fluid chamber adapted for the outflow of fluid to be pumped. A pump, typically of the high flow, low head, impeller or propeller variety, has an intake communicated to the lower chamber and a discharge communicated to the upper chamber. Each of the sidewalls includes a first opening portion for establishing fluid communication between the lower chamber of said housing and the adjacent reservoir and a second opening portion for establishing fluid communication between the upper chamber and the fluid reservoir. By the simple expedient of opening one portion of one sidewall to the upper chamber and opening a second portion in the other sidewall to the lower chamber, selective directional flow between the adjacent reservoirs can occur.

Objects and Advantages of the Invention

An object of this invention is to provide a combination housing and pump manifold system for providing directional flow between reservoirs separated by a barrier such as a levee. Accordingly, a housing having two sidewalls is disclosed. One sidewall forms a water-tight barrier to one reservoir; the other sidewall forms a water-tight barrier to the other reservoir. The housing itself is divided into a lower portion for receiving water and an upper portion for the discharge of water. Each of the sidewalls is in turn provided with two portions. One portion when open to the lower chamber provides for the inflow of water from a reservoir. The other sidewall portion when open permits the outflow of water from one of the chambers to a reservoir. When a low head, high flow pump is placed within the housing, by opening and closing of selected portions of each of the sidewalls, transfer of the reservoir fluid (for example, fresh water) can be selectively obtained at the same pump between adjoining reservoirs.

An advantage of this invention is that the number of sidewalls utilized with this invention can exceed two in number. For example, four ponds coming together at respective intersecting dikes or levees can be pumped by a single housing and pump manifold system by providing four respective sidewalls in accordance with this invention.

A further object of this invention is to provide a pump configuration that allows water to be moved from a subset of a plurality of reservoirs to a different subset of the same plurality with as few pumps as possible.

An advantage of this invention is that the use of movable panels allows for reversible flow without making any changes on the pump itself.

A second advantage of this invention is that it is capable of intake and discharge on any of a plurality of sides. Thus it is no longer necessary to have one pump along every interface between adjacent plots. Rather, when a four-sided chamber is used, a single pump can be located at each corner where four plots come together. Thus a rectangular array of $m$ by $n$ rectangular plots can be efficiently serviced by $(m-1)(n-1)$ pumps and a 6 by 3 array only needs10 pumps rather than the 17 or 27 required previously.

A third advantage is that the pump housing (chamber) and the pump itself are constructed from extremely inexpensive material such as standard wood and sheet metal. No castings or valves are required.

Figure 1:
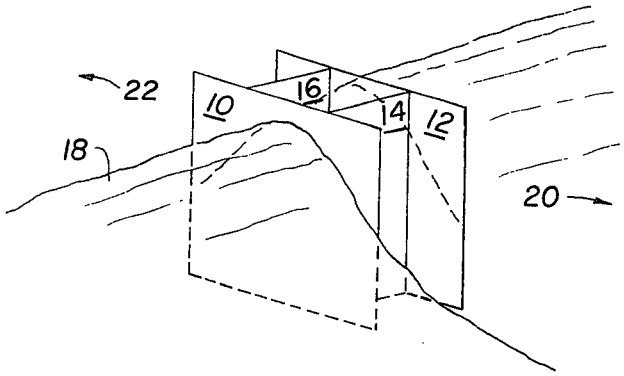
FIG. 1 is a schematic of the chamber of this invention embedded within a levee to provide for reversible pumping from one side of the levee to the other.

FIG. 1 shows the chamber of this invention with sides 10, 12, 14 and 16 located in a levee 18 that separates field 20 from field 22. Sides 14 and 16 confront fields 20 and 22, respectively.

Figure 2:
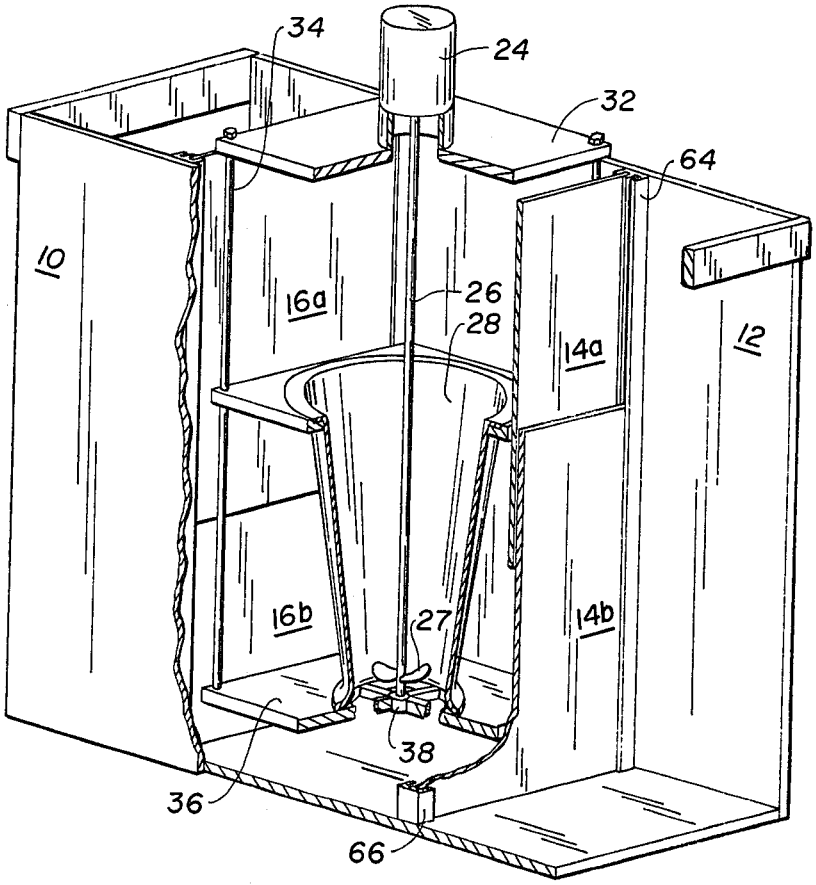
FIG. 2 is a partially cutaway isometric view of a preferred embodiment of the pump and chamber.

FIG. 2 shows the details of the chamber with a pump mounted thereto. The pump in this embodiment consists of a motor 24 mounted above the maximum water level to drive vertical shaft 26 which has propeller 27 mounted near its lower end. Propeller 27 is positioned inside the lower portion of Venturi tube 28. Venturi tube 28 is wider at the top than at the bottom. In operation of the pump, water at the lower end of Venturi tube 28 is accelerated upward by propeller 27 and obtains a velocity head which exceeds the static pressure head at any point in Venturi tube 28. The gradual widening of Venturi tube 28 towards the top provides a deceleration chamber which converts the velocity head into a static head as the water reaches the top of Venturi tube 28. The result is a low lift pump.

In the preferred embodiment, motor 24, which may be a vertical shaft type gasoline engine or electric motor, is mounted to a plate 32 which is connected by threaded rods 34 to a lower member 36 to which the lower rim of Venturi tube 28 is connected. Member 36 also holds bearing 38 which confines the lower end of propeller shaft 26. Additional shaft bearings may be added if needed.

This entire pump assembly is located within a chamber, shown here as being rectangular and oriented with its sides either parallel or perpendicular to the direction of the levee. The two sides 10 and 12 that are perpendicular to the levee direction are essentially solid and fixed, with extensions running beyond the boundaries of the chamber proper since the chamber is narrower than the levee.

Each of the two sides 14 and 16 that are parallel to the levee direction contains a pair of moveable panels (14*a* and 14*b* for side 14; 16*a* and 16*b* for side 16). Referring to side 14 (which is identical to side 16), vertical channels 64 and 66 are provided. Each channel contains two grooves, one for each panel, and the channels are maintained in spaced apart relation so that panels 14*a* and 14*b* can both slide freely in the vertical dimension. It is not necessary that panels 14*a* and 14*b* make up the whole of side 14. All that is necessary is that when lower panel 14*b* is at the lowermost extent of its travel, it prevents the lower end of Venturi tube 28 (i.e. the intake of the pump) from being in fluid communication with field 20 and when upper panel 14*a* is at the uppermost extent of its travel, it prevents the upper end of Venturi tube 28 (i.e. the discharge of the pump) from being in fluid communication with field 20. When both panels 14*a* and 14*b* together are in their upper position, field 20 is in fluid communication with the pump's intake. When both panels 14*a* and 14*b* together are in their lower positions, the pump's discharge is capable of pumping to field 20. If the water level in field 20 is above the top of panels 14*a* and 14*b*, the pump pumps against the pressure head present; if the level of water in field 20 is below the tops of panel 14*a* and 14*b*, the pump discharges and the output flows over the tops of the panels of 14*a* and 14*b* into field 20. While gravity suffices to maintain either panel in the lower position when desired, means are provided for holding either or both in the upper position. Typical means include a sliding bolt and a hook and eye. In sum, panels 14*a* and 14*b* function much as the paired sashes in a traditional double hung window.

Panels 16*a* and 16*b* bear the same relation to the pump and field 22 as do panels 14*a* and 14*b* to the pump and field 20.

The operation of the invention can now be readily understood. Assuming it is desired to pump water from field 20 to field 22, the panels would be arranged as follows. If initially the water level in field 20 is above that in field 22, all panels would be moved to the upper position to let the water levels equalize without pumping. Then panels 14*a* and 14*b* are moved to their upper position, panels 16*a* and 16*b* are moved to their lower position, and pumping is commenced.

Figure 3:
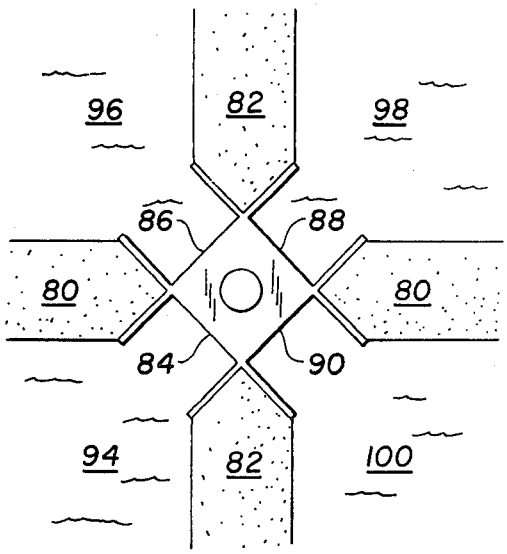
FIG. 3 is a plan view of the pump and chamber located at the intersection of two levees; and, FIG. 4 is a plan view of a rectangular array of plots defined by two intersecting sets of levees with the required pump locations for both this invention and prior art devices.

While the embodiment discussed above only required flow in one of the two possible directions, the invention is not so limited. The chamber may contain any number of sides, all of which may have sliding panels of the type described. FIG. 3 is a plan view of a four-sided chamber oriented diagonally at the intersection of two levees 80 and 82. The chamber sides 84, 86, 88 and 90 confront respectively fields 94, 96, 98 and 100 which are defined by levees 80 and 82. Each chamber side has upper and lower sliding panels 84*a* and 84*b* for side 84, 86*a* and 86*b* for side 86, 88*a* and 88*b* for side 88, and 90*a* and 90*b* for side 90.

To move water from any one of the fields to any other involves putting all lower panels in their lower position except the lower panel on the side confronting the field to be drained. Also, all upper panels except the one on the side confronting the field to be flooded are moved to their upper position. The pump is started and the desired transfer occurs.

Figure 4:
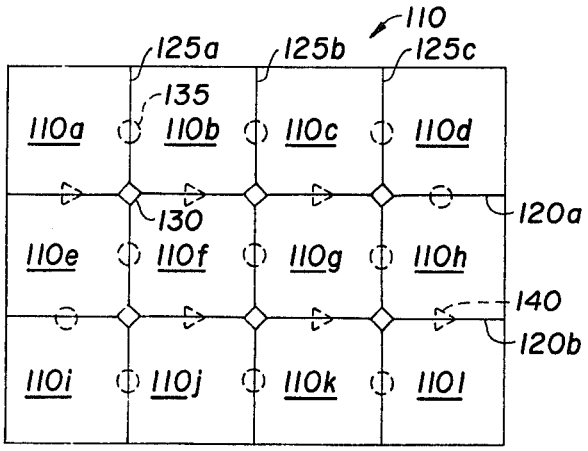

The possibility of greatly reducing the number of pump locations is illustrated in FIG. 4. A large field 110 is divided into plots 110a, 110*b*, 1101 by levees 120*a*, 120*b* in one directon and 125*a*, 125*b*, 125*c* in the other direction. By locating pumps 130 as illustrated in FIG. 3, a total of six pumps allows water to be pumped from any field to any other. If instead, pumps that can only pump from one side of a levee are used, a much greater number are needed. The minimum configuration is shown by locating pumps 135 shown as circles in phantom outline. Aside from the clearly greater number of pumps required, the pumping cannot be by a direct route in general. To take an extreme case, if it is desired to drain plot 110*a* and flood plot 1101, the water must be pumped via every intermediate plot, i.e. 110*b*, 110*c*, . . . ,110*k*. To alleviate this problem, additional pumps 140 are shown as triangles in phantom outline are needed. Eleven pumps become seventeen pumps, rather than the six pumps of the present invention.

This disclosed pumping system is ideally suited for ponds or reservoirs having substantially the same surface water elevation. Where it may be desired to completely dewater a source pond and pump to the water to an adjacent receiving pond, gravity flow may first be used until the elevation between the surface water of the source and receiving pond is equalized. Thereafter, the pump of this invention may be used to complete the desired water transfer. Thus the pump system disclosed herein is usually used to complement a gravity flow system between ponds.

I claim:

1. In a combination a pump and pump manifolding system for producing selective directional liquid flow across a barrier between at least a plurality of adjacent fluid reservoirs, said system comprising: a housing for placement in said barrier having at least two sidewalls, one of said sidewalls forming a fluid-tight barrier with one reservoir and the other of said sidewalls forming a fluid-tight barrier with the other of said reservoirs; said housing divided into upper and lower fluid chambers, said lower fluid chamber adapted for the inflow of fluid to be pumped and said upper fluid chamber adapted for the outflow of fluid to be pumped; a low head pump having an intake communicated to said lower chamber and a discharge communicated to said upper chamber, each of said sidewalls including a first opening portion for establishing fluid communication between the lower chamber of said housing and said adjacent reservoir and a second opening portion for establishing fluid communication between said upper chamber and said fluid reservoir whereby selective manipulation of a first opening portion in one sidewall and a second opening portion in said other sidewall permits said selective directional flow between said adjacent reservoirs.

2. The invention of claim 1 and wherein said low head pump comprises a propeller pump.

3. The invention of claim 2 and including a Venturi housing, said housing extending between said lower chamber and said upper chamber of said pump; said propeller pump mounted within said Venturi housing to produce fluid flow between said respective chambers.

4. A pump manifolding system for use in combination with a low head pump for producing volume flow between respective chambers to produce selective directional liquid flow across a barrier between at least a plurality of adjacent field reservoirs, said system comprising: a housing having at least two sidewalls, one of said sidewalls forming a fluid-tight barrier with one reservoir and the other of said sidewalls forming a fluid-tight barrier with the other of said reservoirs; said housing divided into upper and lower fluid chambers, said lower fluid chamber communicated to the intake of said low head pump and said upper fluid chamber communicated to the outflow of said low head pump; each of said sidewalls including a first opening portion for establishing fluid communication between the lower chamber of said housing and said adjacent reservoir and a second opening portion for establishing fluid communication between the upper chamber and said fluid reservoir whereby selective manipulation of a first opening portion in one sidewall and a second opening portion in the other sidewall permits said selective directional flow between said adjacent reservoirs.

5. The invention of claim 1 and wherein said housing has more than two sidewalls.

6. The invention of claim 4 and where said opening portions of said respective sidewalls include doors movable towards and away from a fluid blocking position between said respective chambers and said reservoirs.

7. In combination, a plurality of reservoirs; a barrier separating said reservoirs; a housing for placement in said barriers having at least two sidewalls, one of said sidewalls forming a fluid-tight barrier with one reservoir and the other of said sidewalls forming a fluid-tight barrier with the other of said reservoirs; said housing divided into upper and lower fluid chambers, said lower fluid chamber adapted for the inflow of fluid to be pumped in said upper fluid chamber adapted for the outflow of fluid to be pumped; a low head pump having an intake communicated to said lower chamber and a discharge communicated to said upper chamber; each of said sidewalls including a first opening portion for establishing fluid communication between the lower chamber of said housing and said adjacent reservoir and a second opening portion for establishing fluid communication between the upper chamber and said fluid reservoir whereby selective manipulation of a first opening portion in one sidewall and a second opening portion in the other sidewall permits selective directional flow between said adjacent reservoirs.

8. The invention of claim 7 and wherein four reservoirs communicate across two intersecting dikes and said housing has four sidewalls with one of said sidewalls forming a fluid-tight barrier with each reservoir.

9. The invention of claim 7 and wherein said opening portions of each said sidewalls comprise opposed U-shaped channels capturing therebetween sliding panels.

* * * * *